US005359174A

United States Patent [19]

Smith et al.

[11] Patent Number: 5,359,174

[45] Date of Patent: Oct. 25, 1994

[54] THERMALLY CONDUCTIVE, INSULATING, ARC-QUENCHING COATING COMPOSITIONS FOR CURRENT INTERRUPTERS

[75] Inventors: James D. B. Smith, Monroeville; John J. Shea, Ross Township, Allegheny County; William R. Crooks, Mt. Lebanon; Norman Davies, Penn Township, Westmoreland County, all of Pa.

[73] Assignee: Eaton Corporation, Cleveland, Ohio

[21] Appl. No.: 114,726

[22] Filed: Aug. 31, 1993

[51] Int. Cl.[5] ..... H01H 33/04; H01H 9/30

[52] U.S. Cl. ..... 200/144 C; 200/149 A

[58] Field of Search ..... 200/144 R–151

[56] References Cited

U.S. PATENT DOCUMENTS

| | | | |
|---|---|---|---|
| 3,761,660 | 9/1973 | Jones | 200/144 C |
| 4,081,852 | 3/1978 | Coley et al. | 361/45 |
| 4,104,238 | 8/1978 | Chenoweth et al. | 200/148 G X |
| 4,251,699 | 2/1981 | Wiltgen, Jr. | 200/144 C |
| 4,444,671 | 4/1984 | Wiltgen, Jr. | 200/144 A |
| 4,516,002 | 5/1985 | Murata et al. | 200/144 C |
| 4,866,226 | 9/1989 | Hisatsune et al. | 200/147 B |
| 4,950,852 | 8/1990 | Goldman et al. | 200/144 C |
| 4,975,551 | 12/1990 | Syvertson | 200/144 C |

*Primary Examiner*—J. R. Scott

*Attorney, Agent, or Firm*—M. J. Moran

[57] ABSTRACT

Effective arc-quenching is desired for current interrupters as defined to include circuit breakers, contactors, fuses and the like under conditions of operation where an electrical arc is produced that must be quenched to eliminate an undesirable current flow. An improved mode of arc-quenching coatings comprising urethane, melamine and acrylic based resin compositions containing inorganic nitrides such as boron nitride, aluminum nitride and silicon nitride are found to be effective as arc-quenching materials for current interrupters. Other coating compositions comprising urethane, melamine and inorganic nitrides mentioned above and high nitrogen organic compounds such as urea, hydantoin, allantoin, guanidine carbonate, guanine, melamine cyanurate and 1,3-diphenyl guanidine are also found to be effective as arc-quenching materials for current interrupters.

20 Claims, 3 Drawing Sheets

THERMALLY CONDUCTIVE, INSULATING, ARC-QUENCHING COATING COMPOSITIONS FOR CURRENT INTERRUPTERS

BACKGROUND OF THE INVENTION

The present invention relates to arc-quenching for current interrupters defined to include circuit breakers, contactors, fuses and the like, wherein under certain conditions of operation an electrical arc is produced that must be quenched to eliminate an undesirable current flow. More particularly, the present invention relates to the use of arc quenching coatings on the surfaces of current interrupters exposed to arcs.

BACKGROUND INFORMATION

In general, current interrupters having arc extinguishing apparatus for electrical contacts have been widely used to electrically interrupt power when overcurrent flows through power source lines. These circuit breakers typically have two types of arc extinguishing apparatus. In miniature circuit breakers, typically, in residential and light commercial installations, the contacts are enclosed in a chamber in the resin casing and partially surrounded by a metal shield as shown for example by U.S. Pat. No. 4,081,852. In larger circuit breakers such as that described in U.S. Pat. No. 4,866,226 arc extinguishers typically comprise a plurality of stacked, substantially U-shaped arc extinguishing plates which surround the fixed and movable contacts of the circuit breaker. However, the second type is commonly used in European and Japanese miniature circuit breakers. When the current interrupter contacts are opened under fault conditions, creating an arc therebetween, the arc is driven and expanded in the direction of the extinguishing plates through electromagnetic action, causing the arc to divide into sections and be cooled down by the arc extinguishing plates so as to be extinguished.

The arc extinguishing plates are typically surrounded by a non-conducting single or double side wall consisting of fiber, such as cotton, or wood pulp, plastic, such as phenolic materials, fishpaper material, or fiberglass. Holes are punched into these side walls to position and support the arc extinguisher plates, thereby creating the necessary spacing between the plates to enhance arc extinguishing capability. The protruding ends of the arc extinguisher plates are typically attached to the side wall by staking or spinning, the side wall and each pair of adjacent arc plates defining a chute for extinguishing the arc segmented by the plates.

Arc-extinguisher side walls have in the past been formed of fibers within a melamine resin matrix, as disclosed in U.S. Pat. No. 4,950,852. Such resins are used to provide a continuous source of arc-quenching gaseous molecular compounds evolved by the heat of the arc.

Others have used side walls formed of a composite material of fiber and a net or porous material having more than 35% apparent porosity to make the arc extinguisher side walls light-absorbing. See U.S. Pat. No. 4,516,002.

U.S. Pat. No. 4,975,551 discloses an arc extinguishing composition comprising an arc-interrupting compound, such as melamine, which is disposed along the path of the arc in combination with a binder composition.

U.S. Pat. No. 4,251,699 discloses an arc-quenching composition comprising a dicyandiamide and an elastomeric binder. The composition is placed sufficiently near the arc such that the heat of the arc causes deionizing and extinguishing gas to be emitted from the composition, thereby extinguishing the arc. The same effect is achieved as disclosed in U.S. Pat. No. 4,444,671 with a composition comprising hexamethylenetetramine, either alone or in combination with a binder or impregnated on other material.

U.S. Pat. No. 3,761,660 discloses an arc interrupting composition of alumina and melamine for the arc-exposure walls or surfaces of electric circuit interrupting devices.

Others have sprayed resin coatings onto the side walls or applied high temperature adhesive tape to the side walls.

Despite these attempts, none of the known devices or techniques fully satisfies all the needs of a reliable current interrupter.

The fiber material used in the side walls frequently experiences arc resistance surface penetration, and thermal breakdown. Many prior art current interrupters experience voltage tracking up the side walls as a result of carbon buildup on the side walls from the intense heat of the arc.

This invention is also applicable to the miniature circuit breaker wherein the miniature circuit breaker has another type of arc chamber geometry consisting only of a metal shield and plastic walls of the breaker.

OBJECTS OF THE INVENTION

It is an object of the invention to provide improved thermally conductive, insulating, arc-quenching coating compositions which reduce let-through current and energy for current interrupters.

It is an object of the invention to prevent voltage tracking up the current interrupter side walls by eliminating carbon buildup on the side walls.

It is another object of the invention to improve the arc resistance surface penetration into fiber materials comprising the structures exposed to arcs in current interrupters.

It is another object of the invention to prevent thermal breakdown of the side walls.

It is still another object of the invention to improve the arc resistance surface penetration into the shield exposed to arcs in miniature circuit breakers.

SUMMARY OF THE INVENTION

It has long been considered desirable to increase the interruption ratings of the miniature current interrupters commonly used for residential purposes in load centers. There has been a long felt need for miniature current interrupters with a 240 V/10 kA single pole interruption rating. Present miniature single pole current interrupters typically have a rating of 120 V/10 kA. The present breakers fail to interrupt 240 V/10 kA.

One promising method for achieving the desired 240 V/10 kA single pole rating is the use of the arc-quenching coatings described below. These low cost, non-toxic coatings are painted or sprayed directly on the arc chamber walls and components of the existing breaker. No tooling or mold modifications are required. Another possibility is to add the non-toxic chemical additive directly to the molding resin prior to curing. The arc-quenching coating produces gases which are shown to reduce the let-through energy during a short circuit test. Thus, interruption ratings may be increased for similar life.

These coatings can be used for arc-quenching in other current interrupters including any size molded case circuit breaker and contactor, and in fuses. Benefits from the coating include: reductions in let-through current and energy, enhanced thermal conductivity, and low carbon content, no modifications to tooling, and low cost.

An improved mode of arc-quenching coatings comprising urethane, melamine and acrylic based resin compositions containing inorganic nitrides such as boron nitride, aluminum nitride and silicon nitride are found to be effective as arc-quenching materials for current interrupters. Other coating compositions comprising urethane, melamine and of acrylic based resin compositions containing mixtures of the inorganic nitrides mentioned above and high nitrogen organic compounds such as urea, hydantoin, allantoin, guanidine carbonate, guanine, melamine cyanurate and 1,3-diphenyl guanidine are also found to be effective as arc-quenching materials for current interrupters.

It is perceived that for applications in current interrupters, a combination of good electrical insulation and high thermal conductivity are necessary prerequisites for satisfactory performance. Inorganic nitrides were selected as additives because of their known outstanding. dielectric properties combined with high thermal conductivity. Using a urethane resin binder with boron nitride or a high nitrogen organic/boron nitride mixture results in a formulation which is low in carbon thereby minimizing the tendency for restrikes during recovery. Minimal carbon on the surfaces exposed to arcs of current interrupters also improves the required surface tracking withstand capabilities.

DESCRIPTION OF THE PREFERRED EMBODIMENTS

Figure 1:
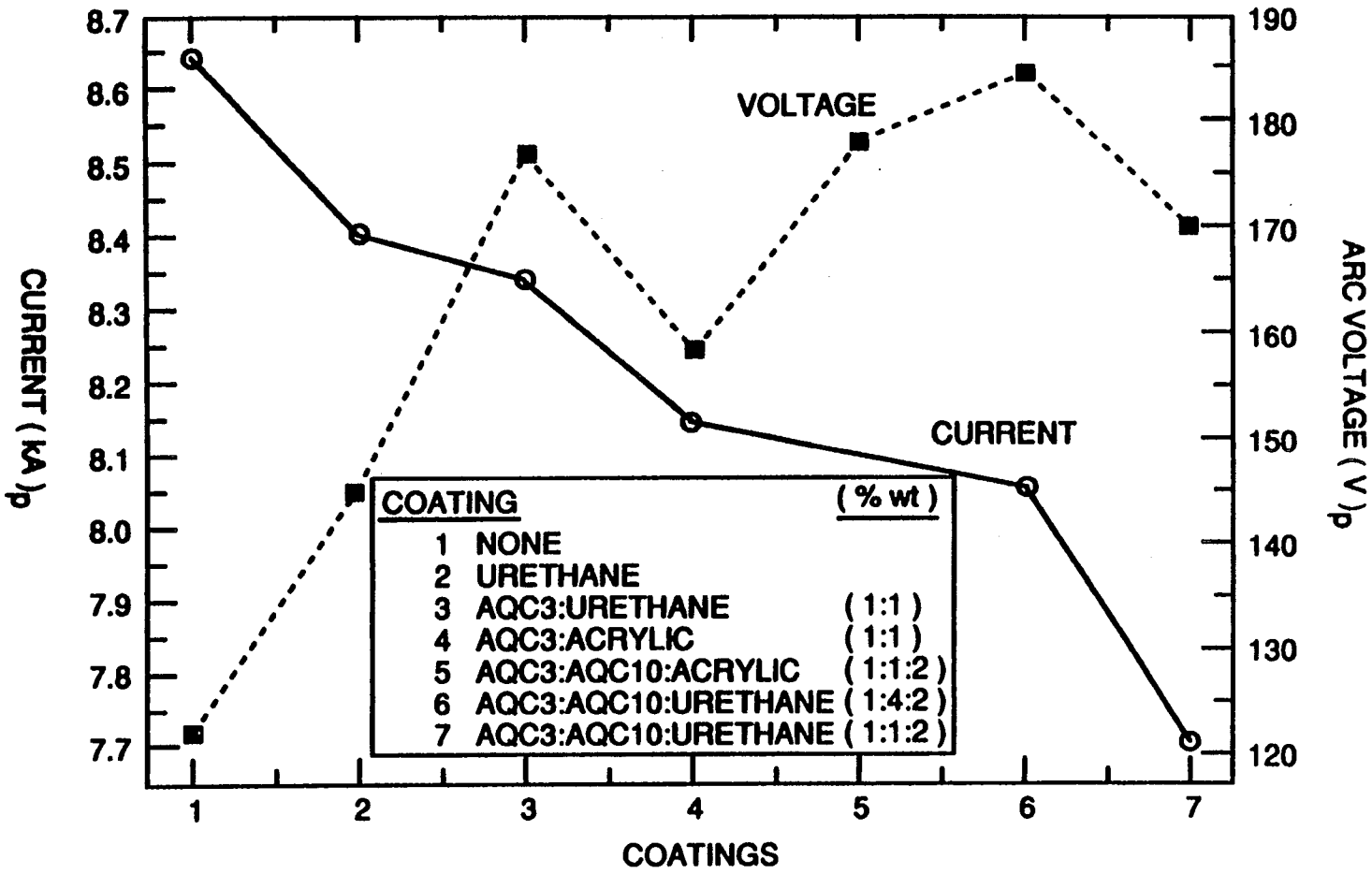
FIG. 1 compares the effectiveness of coating mixtures in miniature circuit breakers (50 amp rated) in accordance with the invention and an uncoated sample on the let-through current.

A method for achieving the desired 240 V/10 kA single pole rating is the use of the arc-quenching coatings described below. These low cost, non-toxic coatings can be painted or sprayed directly on the arc chamber walls and components of the existing breaker. No tooling or mold modifications are required. Another method is to add the non-toxic chemical additive directly to the molding resin prior to curing. The arc-quenching coating produces gases which reduce the let-through energy during a short circuit test.

These coatings can be used for arc-quenching in other current interrupters including any size molded case circuit breaker and contactor, and in fuses. Benefits from the coating include: reductions in let-through current and energy, enhanced thermal conductivity and low carbon content, no modifications to tooling and low cost.

An improved mode of arc-quenching coatings comprising urethane, melamine-formaldehyde and acrylic based resin compositions including inorganic nitrides, Such as boron nitride, aluminum nitride and silicon nitride, are found to be effective as arc-quenching materials for current interrupters. Table I below measures the dielectric properties of boron nitride compared to other inorganic materials. The inorganics mentioned above were chosen because of their high dielectric strength, thermal stability and lack of carbon residue.

TABLE I

DIELECTRIC PROPERTIES OF BORON NITRIDE COMPARED TO OTHER INORGANIC MATERIALS

| Material | Dielectric Strength* (125 Mils, Volts/Mil) at 25° C. | Dielectric Constant** (1 MHz) at 25° C. | Dissipation Factor** (1 MHz) at 25° C. |
|---|---|---|---|
| Boron Nitride | 950 | 4.2 | 0.0003 |
| Urea Formaldehyde | 650–700 (Alpha Cellulose Filler) | 6.6+ | |
| Alumina | 340 | 10.1 | 0.0002 |
| Aluminum Silicate | 150 | 4.1 | 0.0027 |
| Porcelain | 140+ | 8.5 | 0.0005 |
| Quartz | — | 3.8 | 0.0038 |
| Silica (Fused) | — | 3.2 | 0.0045[a] |

*ASTM D149
**ASTM D150
[a]Measured at 10 GHz
+F. M. Clark, Insulating Materials for Design and Engineering Practice, John Wiley & Sons, Inc., New York, 1962

The urethane, melamine and acrylic based resins were chosen because of their desired characteristics. Polyurethane resin (Hysol PC-18) is manufactured by Dexter Hysol, Inc., and the acrylic resin (Humiseal IB-31) is manufactured by Columbia Chase, Inc. The resin melamine-formaldehyde can also be used. The desired characteristics of these resins are as follows:

Properties of the Film-Forming Resins PC-18 and IB-31

Solids content (polymer content)=35–65% (W/W)
Viscosity=300–900 cps
Shelflife=>12 months at ambient temperature
Cure time=1–4 hours at ambient temperature Other coating compositions comprising urethane, melamine and acrylic based resin compositions containing mixtures of the inorganic nitrides mentioned above and high nitrogen organic compounds such as urea, hydantoin, allantoin, guanidine carbonate, guanine, melamine cyanurate and 1,3-diphenyl guanidine are also found to be effective as arc-quenching materials for current interrupters. These high nitrogen organics were chosen because of the arc-quenching gases released [$N_2$, $NH_3$ and $H_2$] increase arc chamber pressure which aids in the interruption of the arc.

In a first embodiment of the invention, boron nitride powder is added to urethane resin (PC-18 available from Hysol/Dexter) in an amount of about 50% by weight to produce a coating material that is easily brushable and sprayable on current interrupter surfaces exposed to arcs. The boron nitride is identified as AQC-3 for experimental purposes. In another embodiment of the invention, a coating is prepared wherein boron nitride powder is added to the urethane or acrylic resin to a level of 25% by weight and a high nitrogen organic, such as allantoin (AQC-10), is added to the same urethane resin to a level of 25% by weight to give a coating material that is easily brushable and sprayable on current interrupter surfaces exposed to arcs. This mixture is used to paint the inside of the arc chamber area of two miniature circuit breakers. These breakers were then short circuit tested.

EXAMPLE 1

Miniature circuit breakers, rated at 50 Amps, were used to test the effectiveness of mixtures of AQC-3 with a high nitrogen organic materials. The organic materials were chosen based on their chemical composition and previous experience in using them as gas-evolving materials. The AQC-3 is an inorganic such as boron nitride, silicon nitride, and aluminum nitride which were chosen because of their high thermal conductivity, high dielectric strength, and high thermal stability (See Table I). These are desirable properties for a circuit breaker arc chamber material. AQC-3 mixed with a non-carbon forming gas evolving high nitrogen organic allantoin (AQC-10) was thought to be a good candidate for a coating in a circuit breaker's arc chamber.

A short circuit test was conducted on the 50 Amp breakers to determine the effectiveness of various coating mixtures given in Table II below. The arc chamber and arc shield of the 50 amp breakers were coated with the mixture and cured at 60° C. for two hours. A capacitor discharge circuit was used to produce a single half-wave 60 Hz current pulse at a typical current magnitude for this type of breaker. An equal charging voltage was used for all shots so that the let-through currents and arc voltages could be directly compared.

TABLE II

Compositions for Example 1
Miniature Circuit Breaker Tests
The following compositions were prepared, using the procedure described previously, for evaluation in a Miniature Circuit Breaker (50 amp ratings):

| No. | Polymer Resin Binder (% W/W) | Inorganic Compound (% W/W) | Gas Evolving Organic Compound Compound (% W/W) |
|---|---|---|---|
| 1. | None<br>0 | None<br>0 | None<br>0 |
| 2. | Urethane (PC-18)<br>100 | None<br>0 | None<br>0 |
| 3. | Urethane (PC-18)<br>50 | Boron Nitride<br>50 | None<br>0 |
| 4. | Acrylic (IB-31)<br>50 | Boron Nitride<br>50 | None<br>0 |
| 5. | Acrylic (IB-31)<br>50 | Boron Nitride<br>25 | Allantoin<br>25 |
| 6. | Urethane (PC-18)<br>28 | Boron Nitride<br>15 | Allantoin<br>57 |
| 7. | Urethane (PC-18)<br>50 | Boron Nitride<br>25 | Allantoin<br>25 |

FIG. 1 shows the results for the combinations tested. Each data point is the average of two shots except for the uncoated breaker (average of six shots) and for coating 7 (average of three shots). Each shot was performed using a new coating. Multiple shots on a single pole were not performed. As the arc voltage increases, the let-through current decreases. This is a common characteristic of a current limiting breaker. The worst condition occurred for the breaker with no coating. The best current limiting action was from the combination of AQC-3:AQC-10:Urethane with a weight ratio of 1:1:2. This combination showed improved performance over the urethane alone as well as the AQC-3:Urethane coating. Coating mixture 6 may be considered to have better performance than coating 7 because mixture 6 had a higher arc voltage. Further testing will be required to optimize the coating mixture (i.e. weight ratios, thickness, coating location).

EXAMPLE 2

Similar tests using seven coatings listed in Table III below were conducted on a larger size (150 Amp rating) current limiting circuit breaker. The entire inside of the arc chamber was coated as well as the deion plates.

TABLE III

Compositions for Example 2
150 Amp Rated Current Limiting Circuit Breaker Tests
The following compositions were prepared for evaluation on a larger size circuit breaker (150 Amp rating):

| No. | Polymer Resin Binder (% W/W) | Inorganic Compound (% W/W) | Gas Evolving Organic Compound Compound (% W/W) |
|---|---|---|---|
| 1. | None<br>0 | None<br>0 | None<br>0 |
| 2. | Urethane (PC-18)<br>67 | Boron Nitride<br>16 | Urea (AQC-11)<br>17 |
| 3. | Urethane (PC-18)<br>67 | Boron Nitride<br>16 (AQC-3) | Allantoin (AQC-10)<br>17 |
| 4. | Urethane (PC-18)<br>50 | Boron Nitride<br>50 | None<br>0 |
| 5. | Acrylic (IB-31)<br>44 | Boron Nitride<br>44 | Guanine (AQC-2)<br>12 |
| 6. | Urethane (PC-18)<br>28 | Boron Nitride<br>15 | Allantoin<br>57 |

Figure 2:
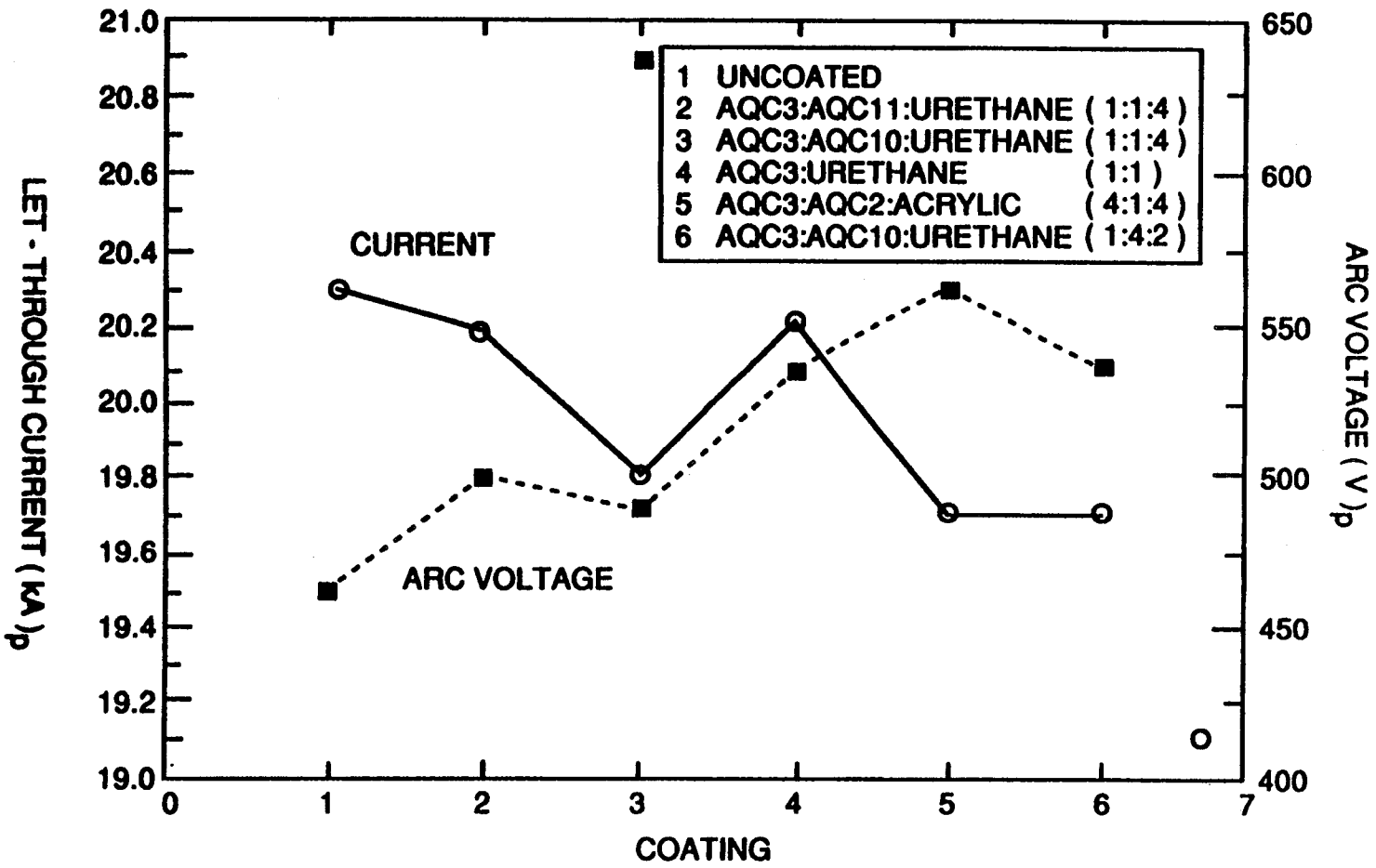
FIG. 2 shows the effect of coating mixtures on the corresponding arc voltage in larger size current limiting circuit breakers (150 amp rated).
Figure 3:
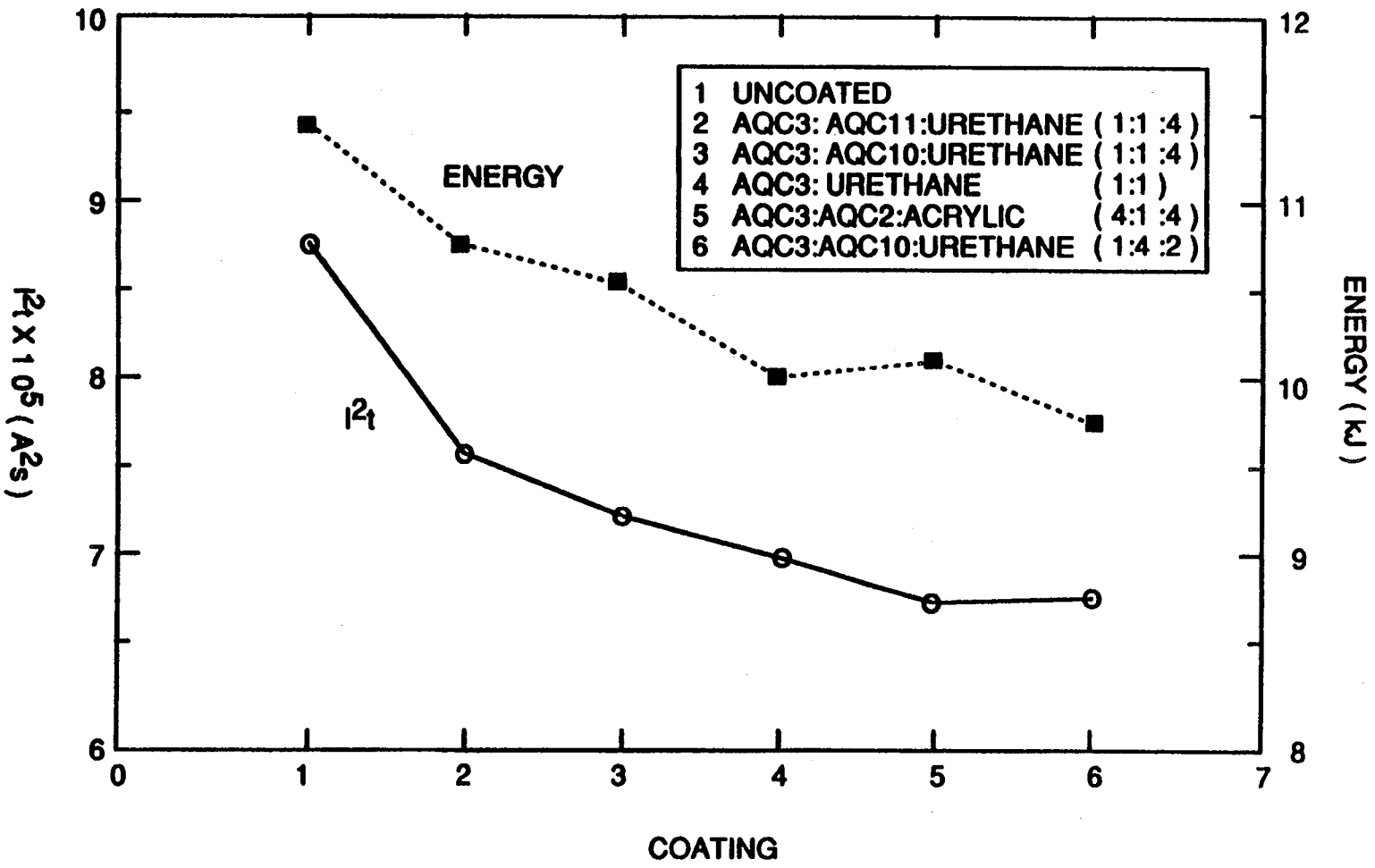
FIG. 3 shows a further comparison of the reduction in let-through energy effected by the invention in the larger size breakers (150 amp rated).

FIG. 2 shows the effect of the coatings on the interruption of 150 amp rated current limiting circuit breakers with deion plates. FIG. 3 shows the corresponding let-through energy on the breakers tested in FIG. 2. The results again show that a mixture of AQC-3 with an organic performs better than the AQC-3 alone (FIGS. 2–3). Each data point shown is one single shot on the breaker pole. The best two mixtures were coatings 5 and 6 which had the lowest $I^2t$ and energy levels of the coatings tested.

The reasons for the improved performance in Examples 1 and 2 include:

1. Gas-evolving coatings create higher transient pressure rises in the arc chamber which decrease the conductivity of the arc, thereby increasing the arc voltage and reducing let-through current.
2. The chemical composition of the gases evolved have a higher thermal conductivity (i.e. hydrogen, ammonia and nitrogen) which help to cool the arc thereby decreasing its conductivity. The gases also have a higher dielectric strength and electron affinity than the gases created from an uncoated breaker and increase the recombination rate of electrons with ions and neutrals.
3. Certain combinations of gases may have a synergistic affect on the arc as seen by the test results for combined mixtures.
4. Unlike standard breakers, these coatings do not produce any carbon residue which can prevent interruption or produce a dielectric failure.

From the experimental data obtained, it appears that these urethane coating compositions, particularly the one containing boron nitride (AQC-3) and urea (AQC-11), allantoin (AQC-10) and guanine (AQC-2) have a measurable beneficial effect on the arc-quenching capabilities of breakers. In this particular example, the arc-quenching gases released are $N_2$, $NH_3$ and $H_2$. These gas evolving coatings increase arc chamber pressure which aides in the interruption of the arc. There is little or no carbon produced and therefore reduced arc tracking limiting restriking. The benefit is due to build-up in gas pressure from the decomposition of the coating material and, more importantly, from the arc-quenching effect of the various gases produced in the arc (e.g., hydrogen, nitrogen).

There is a beneficial chemical reaction between certain gas-evolving high nitrogen organic additives such as urea, allantoin, guanine, etc., and film-forming polymer materials such as urethane and acrylic. This would be particularly the case between the gas-evolving additives containing hydroxyl (—OH) and amino ($NH_2$, NHR) groups and a urethane film-forming polymer. In this instance, polymeric "adducts" are formed which would enhance the thermal stability of the composition without jeopardizing the arc-quenching properties. The additional stability arises from the formation of chemical bonds between the gas-evolving compounds and the urethane resin. Increased "cross-linking" of polymer molecules is also possible, enhancing stability even further. Also additives, such as boron nitride, can be used in molding formulations (e.g. BMC glass/polyester) as an alternative to using them in coating compositions.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

We claim:

1. An arc-quenching composition comprising:

an effective amount of an inorganic nitride for arc-quenching, and a polymeric resinous binder selected from the group consisting of urethane, melamine and acrylic based resins.

2. A composition of claim 1, wherein the inorganic nitride is selected from the group consisting of boron nitride, silicon nitride and aluminum nitride.

3. A composition of claim 2, wherein the inorganic nitride is boron nitride.

4. A composition of claim 3, wherein the polymeric resinous binder is polyurethane.

5. An arc-quenching composition comprising:

an effective amount of a mixture of an inorganic nitride selected from the group consisting of boron nitride, aluminum nitride, and silicon nitride and a high nitrogen organic compound selected from the group consisting of urea, allantoin, hydantoin, guanidine carbonate, guanine, melamine cyanurate, and 1,3-diphenyl guanidine for arc quenching and a polymeric resin binder selected from the group consisting of urethane, melamine and acrylic based resins.

6. A method for quenching an electrical arc in a current interrupter consisting of coating a portion of said current interrupter with an arc-quenching composition comprising: an amount of an inorganic nitride selected from the group consisting of boron nitride, aluminum nitride, and silicon nitride effective for arc-quenching.

7. The method of claim 6, wherein the arc-quenching composition also includes a polymeric resin binder selected from the group consisting of urethane, melamine and acrylic based resins.

8. The method of claim 7, wherein the inorganic nitride selected from the group consisting of boron nitride, aluminum nitride and silicon nitride comprises at least about 10% by weight of the total arc-quenching composition.

9. The method of claim 8, wherein the inorganic nitride selected from the group consisting of boron nitride, aluminum nitride and silicon nitride comprises from about 15 to 65% by weight of the total arc-quenching composition.

10. The method of claim 9, wherein the inorganic nitride is boron nitride and the polymeric resin binder is polyurethane.

11. A method for quenching an electrical arc in a current interrupter consisting of coating a portion of said current interrupter with an arc-quenching composition comprising:

an amount of mixture of an inorganic nitride selected from the group consisting of boron nitride, aluminum nitride and silicon nitride and a high nitrogen organic compound selected from the group consisting of urea, allantoin, hydantoin, guanidine carbonate, guanine, melamine cyanurate, and 1,3-diphenyl guanidine effective for arc-quenching so that the heat of the arc causes a sufficient quantity of deionizing and extinguishing gas to be emitted from the composition and effectively terminate the arc.

12. The method of claim 11, wherein the arc-quenching composition also includes a polymeric resin binder selected from the group consisting of urethane, melamine and acrylic based resins.

13. The method of claim 12, wherein the arc-quenching mixture comprises at least about 10% by weight of the total arc-quenching composition.

14. The method of claim 13, wherein the mixture comprises about 35 to 85% by weight of the total arc-quenching composition.

15. The method of rendering a current interrupter capable of extinguishing an electrical arc comprising the step of including in said structure an amount of an inorganic nitride selected from the group consisting of boron nitride, aluminum nitride, and silicon nitride effective for arc-quenching.

16. The method of claim 15, wherein the inorganic nitride comprises at least 10% by weight of the structure.

17. The method of claim 16, wherein the inorganic nitride comprises about 35 to 65% by weight of the structure.

18. The method of rendering a current interrupter capable of extinguishing an electrical arc comprising the steps of including in said structure an amount of a mixture comprising an inorganic nitride consisting of boron nitride, aluminum nitride, silicon nitride and a high nitrogen organic compound consisting of urea, allantoin, hydantoin, guanidine carbonate, guanine, melamine cyanurate, and 1,3-diphenyl guanidine effective for arc-quenching.

19. The method of claim 18, wherein the mixture comprises at least 10% by weight of the structure.

20. The method of claim 19, wherein the mixture comprises about 35 to 85% by weight of the structure.

* * * * *